US008289243B2

(12) United States Patent
Baik et al.

(10) Patent No.: US 8,289,243 B2
(45) Date of Patent: Oct. 16, 2012

(54) LIGHT EMITTING DISPLAY

(75) Inventors: Seong Ho Baik, Gunpo-si (KR); In Hwan Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1182 days.

(21) Appl. No.: 11/475,024

(22) Filed: Jun. 27, 2006

(65) Prior Publication Data

US 2007/0002073 A1 Jan. 4, 2007

(30) Foreign Application Priority Data

Jun. 30, 2005 (KR) ..... 10-2005-0058861

(51) Int. Cl.
*G09G 3/30* (2006.01)

(52) U.S. Cl. ..... 345/77; 345/76; 345/82

(58) Field of Classification Search ..... 345/76–77, 345/690, 82, 105, 204; 315/169.1–169.3
See application file for complete search history.

(56) References Cited

U.S. PATENT DOCUMENTS

| | | | | |
|---|---|---|---|---|
| 6,501,230 | B1 * | 12/2002 | Feldman | 315/169.3 |
| 7,158,157 | B2 * | 1/2007 | Yamazaki et al. | 345/690 |
| 7,248,254 | B2 * | 7/2007 | Kato | 345/690 |
| 2003/0107546 | A1 * | 6/2003 | Ham | 345/101 |
| 2003/0122761 | A1 | 7/2003 | Hong | |
| 2004/0164938 | A1 * | 8/2004 | Choi et al. | 345/76 |
| 2006/0256053 | A1 * | 11/2006 | Baek | 345/88 |
| 2006/0284805 | A1 * | 12/2006 | Baek | 345/88 |
| 2007/0002003 | A1 * | 1/2007 | Kim | 345/102 |

FOREIGN PATENT DOCUMENTS

| | | | |
|---|---|---|---|
| CN | 1512828 | | 7/2004 |
| JP | 2003059650 | A | 2/2003 |
| JP | 2003-177714 | | 6/2003 |
| JP | 2004062150 | A | 2/2004 |
| JP | 2004-325565 | | 11/2004 |
| JP | 2005084353 | A | 3/2005 |
| WO | WO 03/094137 | | 11/2003 |

* cited by examiner

*Primary Examiner* — Joe H Cheng
(74) *Attorney, Agent, or Firm* — McKenna, Long, and Aldridge, LLP.

(57) ABSTRACT

A light emitting display is provided. The light emitting display comprises a pixel circuit unit comprising a plurality of pixels that display an image; a data driver that supplies a data signal to the pixel circuit unit; a scan driver that supplies a scan signal to the pixel circuit unit; a gamma correcting unit that supplies a gamma value to the data driver to control the magnitude of the data signal; and a timing controller that applies control signals to the data driver and the scan driver and that supplies a variable gamma control signal that controls the gamma correcting unit to supply the gamma value that changes according to the data driving time.

4 Claims, 3 Drawing Sheets

LIGHT EMITTING DISPLAY

This application claims the benefit of Korea Patent Application No. 2005-0058861, filed on Jun. 30, 2005, which is hereby incorporated by reference for all purposes as if set forth herein.

BACKGROUND OF THE INVENTION

1. Field of the Invention

The present invention relates to a light emitting display and a method of driving the same.

2. Description of the Related Art

A light emitting device is a spontaneous light emitting device that comprises an light emitting unit formed between two electrodes.

A light emitting display that comprises the light emitting device has a higher response speed and a lower direct current (DC) driving voltage than a passive light emitting device that requires an additional light source such as a liquid crystal display (LCD), and the light emitting display can be made ultra slim. Therefore, the light emitting display can be wall-mounted or portable.

The light emitting device embodies colors using pixels in which red, blue, and green sub pixels represent one color.

The light emitting device is divided into a passive matrix organic light emitting device (PMOLED) and an active matrix organic light emitting device (AMOLED) in which thin film transistors (TFT) are used in accordance with a method of driving the sub pixels.

FIG. 1 is a cross-sectional view of a conventional AMOLED.

Referring to FIG. 1, the conventional AMOLED 30 comprises a thin film transistor (TFT) 34 formed on a substrate 32, a pixel electrode 36 connected to the drain of the TFT 34, multiple organic light emitting layers 38 laminated on the pixel electrode 36, a cathode electrode 40 formed on the organic light emitting layers 38, and a protective layer 42 formed on the cathode electrode 40.

In the conventional AMOLED 30, a data signal is applied to the source of the TFT 34 when a scan signal is applied to the gate of the TFT 34 to supply holes and electrons to the organic light emitting layers 38 through the pixel electrode 36 and the cathode electrode 40 so that the holes and the electrons are re-combined with each other to emit light.

When the conventional AMOLED 30 is initially driven, the brightness of the conventional AMOLED 30 unstably increases and is stabilized after a certain amount of time.

FIG. 2 is a graph illustrating the brightness characteristic of the conventional AMOLED.

Referring to FIG. 2, when the conventional AMOLED 30 is initially driven, the brightness of the conventional AMOLED 30 rapidly increases and then is reduced as illustrated in the graph A, and uniform brightness is obtained after a certain amount of time.

When the conventional AMOLED 30 having the above-described brightness characteristic is continuously driven, the TFT 34 and the organic light emitting layers 38 are damaged so that the life span of the conventional AMOLED 30 is rapidly reduced.

Therefore, in the case of the light emitting display that displays an image using the conventional AMOLED 30, it is difficult to commercialize the light emitting display due to the short life time of the conventional AMOLED 30.

SUMMARY

Accordingly, the present invention is directed to a light emitting display that substantially obviates one or more of the problems due to limitations and disadvantages of the related art.

An advantage of the present invention is to overcome at least the problems and disadvantages of the background art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is provided a light emitting display comprising a pixel circuit unit comprising a plurality of pixels that display an image; a data driver that supplies a data signal to the pixel circuit unit; a scan driver that supplies a scan signal to the pixel circuit unit; a gamma correcting unit that supplies a gamma value to the data driver to control the magnitude of the data signal; and a timing controller that applies control signals to the data driver and the scan driver and that supplies a variable gamma control signal that controls the gamma correcting unit to supply the gamma value that changes according to the data driving time.

In another aspect of the present invention, there is provided a light emitting display comprising a pixel circuit unit comprising a plurality of pixels that display an image; a data driver that supplies a data signal to the pixel circuit unit; a scan driver that supplies a scan signal to the pixel circuit unit; a gamma correcting unit that supplies a gamma value to the data driver to control the magnitude of the data signal; and a timing controller that applies control signals to the data driver and the scan driver and that supplies a variable gamma control signal that controls the gamma correcting unit to supply the gamma value corresponding to the brightness characteristic of the pixel circuit unit to the data driver from the time when the light emitting display is initially driven to a predetermined time.

In still another aspect of the present invention, there is provided a method of driving a light emitting display, the method comprises supplying a scan signal to a pixel circuit unit comprising a plurality of pixels to display an image; and supplying a data signal whose magnitude varies with a gamma value corresponding to a brightness characteristic of the pixel circuit unit while the scan signal is supplied from the point of time when the light emitting display is initially driven to a predetermined time.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are comprised to provide a further understanding of the invention and are incorporated in and constitute a part of this specification, illustrate embodiments of the invention and together with the description serve to explain the principles of the invention.

In the drawings.

DETAILED DESCRIPTION

Reference will now be made in detail to an embodiment of the present invention, an example of which is illustrated in the accompanying drawings.

Figure 3:
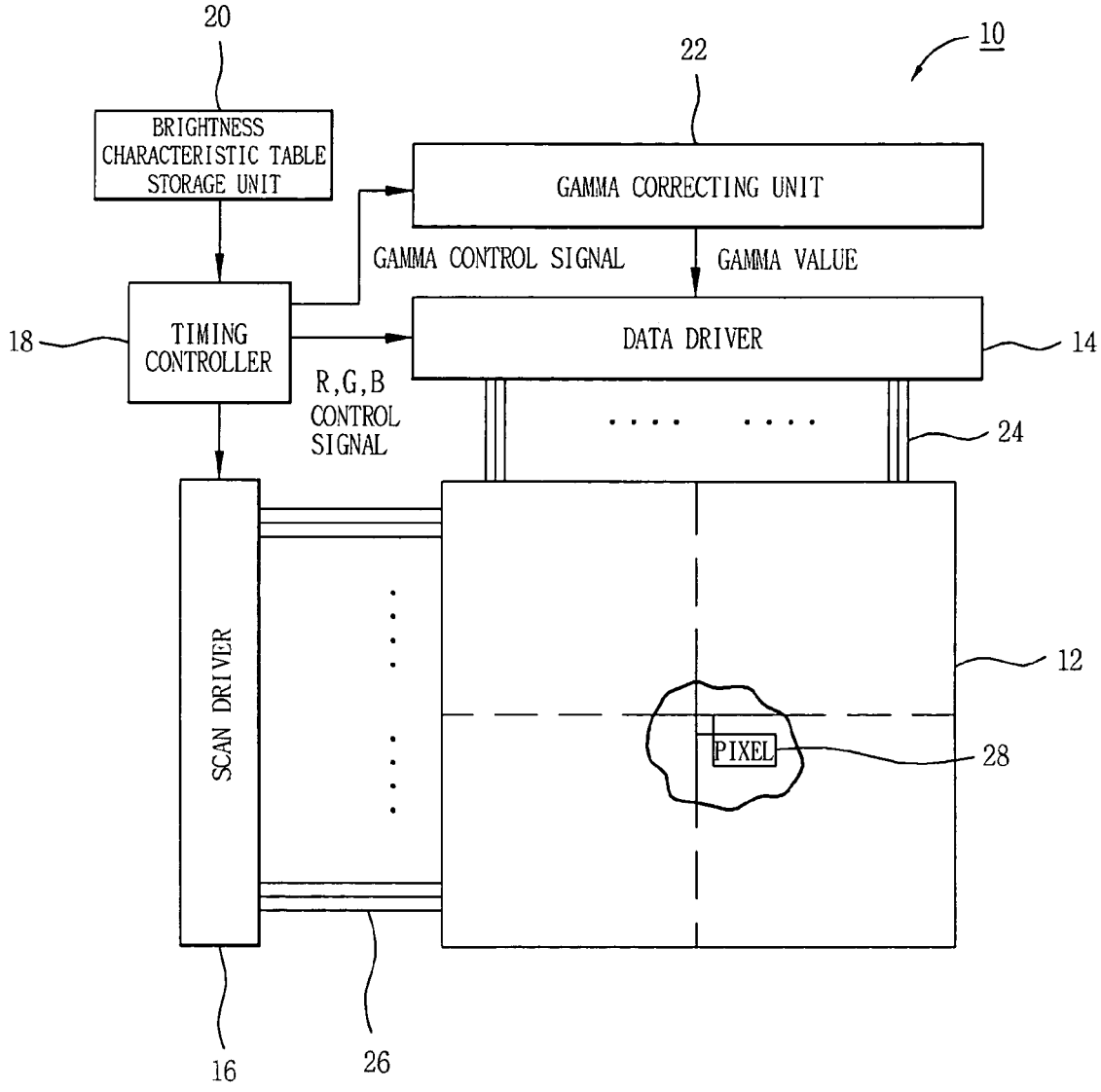
FIG. 3 is a block diagram illustrating a light emitting display system according to an embodiment of the present invention.
Figure 4:
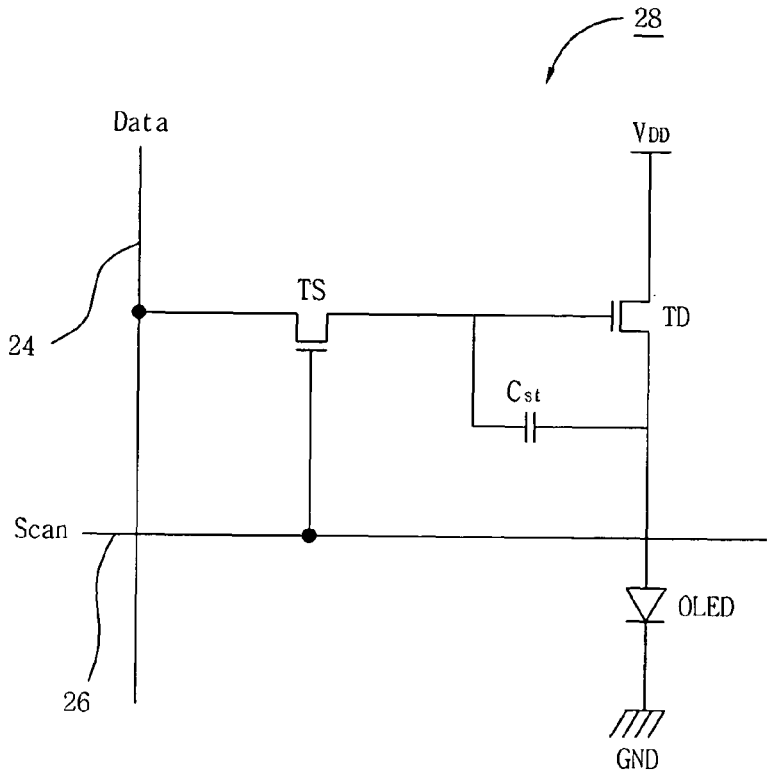
FIG. 4 is an equivalent circuit diagram of the light emitting device of FIG. 3.

FIG. 3 is a block diagram illustrating a system of a light emitting display according to an embodiment of the present invention. FIG. 4 is an equivalent circuit diagram of the light emitting device of FIG. 3.

Referring to FIG. 3, a light emitting display 10 according to an embodiment of the present invention comprises a pixel circuit unit 12, a data driver 14, a scan driver 16, a timing controller 18, a brightness characteristic table storage unit 20, and a gamma correcting unit 22.

A light emitting device 28 is a spontaneous light emitting device that emits light using phosphors and the re-combination of electrons and holes.

The pixel circuit unit 12 comprises a plurality of the light emitting devices 28 formed at the crossings of data lines 24 and scan lines 26.

The pixel circuit unit 12 displays an image on a screen by driving the light emitting devices 28 with an image signal.

Referring to FIG. 4, the light emitting device 28 comprises an organic light emitting diode (OLED), a driving thin film transistor (TFT) TD connected between a power source voltage VDD and the OLED, a storage capacitor Cst connected between the gate and source of the driving TFT TD, a switching TFT TS that is connected between the data line 24 and the gate of the driving TFT TD and whose gate is connected to the scan line 26.

In the light emitting device 28, when a data signal or a data voltage is applied through the data line 24 when a scan signal is applied through the scan line 26, the switching TFT TS is turned on to transmit the data signal to the driving TFT TD.

The data signal is stored in the storage capacitor Cst to drive the driving TFT TD although the scan signal is erased and to supply an output current to the OLED.

Therefore, because the light emitting device 28 controls the magnitude of the data signal or the data voltage, it is possible to control the brightness of the OLED.

The data driver 14 applies the data signal to the light emitting device 28 of the pixel circuit unit 12 through the data line 24.

The data driver 14 applies the data signal or data voltage whose magnitude varies according to the gamma value of the gamma correcting unit 22 to the light emitting device 28 through the data line 24.

The data driver 14 may be an additional integrated circuit (IC) or may be formed on a panel.

The data driver 14 may be one or more than two.

The scan driver 16 applies a scan signal or a selection signal to the light emitting device 28 of the pixel circuit unit 12 through the scan line 26.

The scan driver 16 may be one or more than two.

The timing controller 18 supplies an R, G, and B control signal and a scan control signal to the data driver 14 and the scan driver 16 for controlling the data driver 14 and the scan driver 16.

The timing controller 18 supplies a variable gamma control signal to the gamma correcting unit 22 to control the gamma value that the gamma correcting unit 22 supplies to the data driver 14.

To be specific, the timing controller 18 supplies the variable gamma control signal to the gamma correcting unit 22 so that the gamma correcting unit 22 supplies the variable gamma value to the data driver 14 according to the driving time of the data driver.

The gamma value stored in the brightness characteristic table storage unit 20, varies with the brightness characteristic. The brightness characteristic varies according to the driving time of the light emitting device 28.

The brightness characteristic table storage unit 20 stores a variety of the brightness characteristics according to the driving time of the light emitting device 28.

Figure 5:
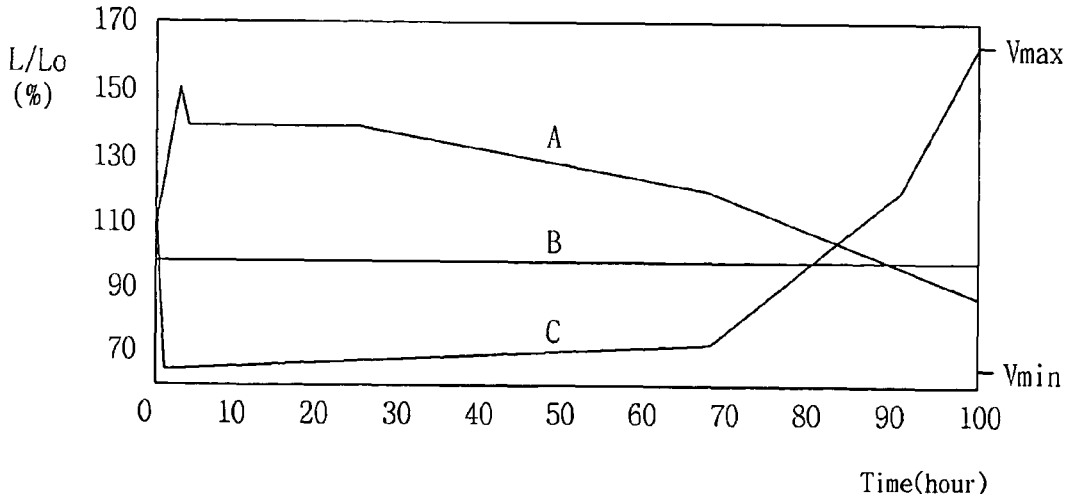
FIG. 5 is a graph illustrating the brightness characteristic of a light emitting device according to an embodiment of the present invention.

FIG. 5 is a graph illustrating the brightness characteristic of a light emitting device according to an embodiment of the present invention.

The graph A of FIG. 5 illustrates the brightness characteristics stored in the brightness characteristic table storage unit 20 that represents the brightness characteristic according to the driving time of the light emitting device 28.

The graph B illustrates an expected brightness characteristic of the light emitting display 10 according to an embodiment of the present invention that varies according to the driving time of the light emitting device 28.

The graph C illustrates the characteristics of the data signals or the data voltages that are supplied to the light emitting device 28 through the data line 24 by the data driver 14.

Referring to the graph A of FIG. 5, the brightness characteristic stored in the brightness characteristic table storage unit 20 varies according to the driving time of the light emitting device 28.

The brightness characteristic table storage unit 20 supplies the brightness characteristics according to the driving time of the light emitting device 28 to the timing controller 18.

Referring to FIG. 3, the timing controller 18 supplies the variable gamma control signal to the gamma correcting unit 22 in accordance with the above-described brightness characteristic.

The gamma correcting unit 22 supplies the gamma value that offsets the variation of the brightness characteristic when the light emitting device 28 is initially driven to the data driver 14.

The graph C of FIG. 3 illustrates that the data signal or data voltage that the data driver 14 applies to the light emitting device 28 through the data line, and the data signal varies corresponding to the gamma value that the gamma correcting unit 22 supplies to the data driver 14 and varies according to the brightness characteristic.

Referring to FIG. 5 again, the data voltage driven as illustrated in the graph C offsets the brightness characteristic of the light emitting device 28 as illustrated in the graph A so that the light emitting display 10 according to an embodiment of the present invention has the brightness characteristic as illustrated in the graph B.

To be specific, the minimum data signal V_min is applied to the light emitting device 28 at a first time when the light emitting device 28 is initially driven. Next, a data signal that is more than the minimum data signal V_min is applied to the light emitting device 28 at a point in time after the first time.

The maximum data signal V_max is applied to the light emitting device 28 when the driving time of the light emitting device 28 is more than a second time, for example, 100 hours so that the driving of the light emitting display 10 is stable.

The brightness characteristic of the light emitting device 28 as illustrated in the graph A of FIG. 5 is stored in the brightness characteristic table storage unit 20 and the gamma correcting unit 22 supplies the gamma value corresponding to the brightness characteristic of the light emitting device 28 to the data driver 14.

The data driver 14 applies the data signal or data voltage corrected in accordance with the gamma value to the light emitting device 28 through the data line. The applied data voltage equals the voltage shown in FIG. 5C.

The light emitting display 10 according to an embodiment of the present invention preferably has the brightness characteristic as illustrated in graph B. Because the data voltage varies from the maximum data voltage V_max to the minimum data voltage V_min, the light emitting display 10 emits brightness uniformly.

An embodiment of the present invention was described with reference to the drawings. However, the present invention is not limited to the above embodiment.

In the above embodiment, the light emitting device 28 comprises the pixel structure as illustrated in FIG. 4. However, the present invention is not limited to the above pixel structure but the light emitting device 28 may embody various pixel structures.

For example, the light emitting device 28 may comprise a threshold voltage compensating unit for compensating for the threshold voltage of the driving TFT TD.

Figure 1:
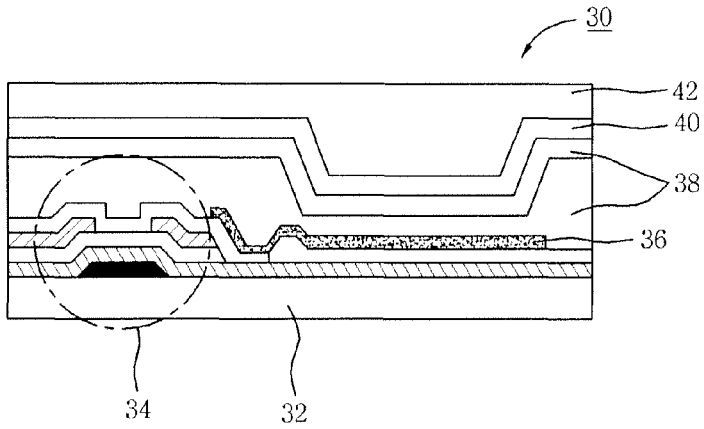
Fig. 1 RELATED ART
FIG. 1 is a cross-sectional view of a conventional active matrix organic light emitting device (AMOLED).
Figure 2:
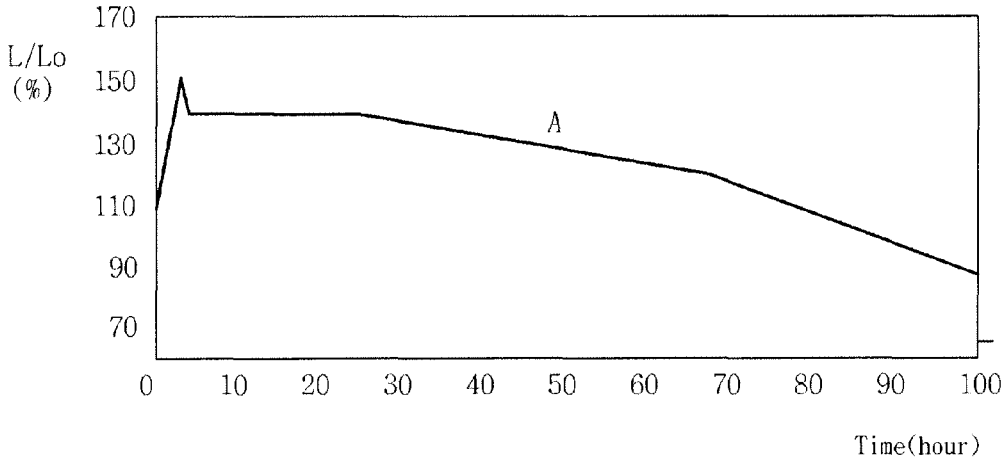
Fig. 2 RELATED ART
FIG. 2 is a graph illustrating the brightness characteristic of the conventional AMOLED.

Also, the light emitting device 28 may be the conventional light emitting device illustrated in FIG. 1. The LED 28 may also comprise current or future types of light emitting devices.

In the above embodiment, after storing the brightness characteristic of the light emitting device 28 in the brightness characteristic table storage unit 20, the gamma correcting unit 22 supplies the gamma value that varies corresponding to the brightness characteristic of the light emitting device 28 to the data driver 14. However, without additionally storing the brightness characteristic in the brightness characteristic table storage unit 20, the timing controller 18 or the gamma correcting unit 22 may supply the variable gamma value that varies according to the driving time of the light emitting device 28 to the data driver 14.

The gamma correcting unit 22 may also be within the data driver 14.

The gamma correcting unit 22 may comprise a digital gamma unit.

The brightness characteristic of the light emitting device that is illustrated according to an embodiment of the present invention is stable when the driving time is less than or equals to 100 hours, that is, preferably about 90 hours. However, the present invention is not limited to the above embodiment. Also, the brightness characteristic that varies according to the driving time of the light emitting device may vary corresponding to the materials of the light emitting device or the characteristics of the driver.

The pixel circuit unit of the light emitting device according to an embodiment of the present invention may comprise one or more organic light emitting layers and inorganic light emitting layers.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light emitting display comprising:

a pixel circuit unit comprising a plurality of pixels that display an image;

a data driver that supplies a data signal to the pixel circuit unit;

a scan driver that supplies a scan signal to the pixel circuit unit;

a brightness characteristic table storage unit that stores a brightness characteristic that is varied according to the driving time of the pixel circuit unit;

a timing controller that applies control signals to the data driver and the scan driver, and that supplies a first gamma control signal from a first time to a second time, a second gamma control signal from the second time to a third time and a third gamma control signal after the third time according to the brightness characteristic stored on the brightness characteristic table storage unit; and a gamma correcting unit that supplies a first gamma value to the data driver according to the first gamma control signal, a second gamma value to the data driver according to the second gamma control signal, and a third gamma value to the data driver according to the third gamma control signal, wherein the data driver supplies a first data signal to the pixel circuit unit from the first time when the light emitting device is initially driven to the second time according to the first gamma value to offset a variation of the brightness characteristic unstably increased when the light emitting device is initially driven, supplies a second data signal to the pixel circuit unit from the second time to the third time according to the second gamma value, and supplies a third data signal to the pixel circuit unit after the third time according to the third gamma value, and wherein the first data signal is gradually decreased, the second data signal is gradually increased, and the third data signal is constant.

2. The light emitting display as claimed in claim 1, wherein the second time is the when the pixel circuit unit emits a brightness in a predetermined range.

3. The light emitting display as claimed in claim 1, wherein the gamma correcting unit comprises a digital gamma unit that is integrated with the data driver.

4. The light emitting display as claimed in claim 1, wherein the pixel comprises organic light emitting layers formed between two electrodes.

* * * * *